United States Patent [19]

Boik

[11] Patent Number: 4,576,298

[45] Date of Patent: Mar. 18, 1986

[54] TAMPER INDICATING FITMENT

[75] Inventor: Elmer J. Boik, Lombard, Ill.

[73] Assignee: Continental White Cap, Inc., Northbrook, Ill.

[21] Appl. No.: 608,305

[22] Filed: May 8, 1984

[51] Int. Cl.[4] ..... B65G 67/02

[52] U.S. Cl. ..... 215/252; 215/225; 215/250; 215/274

[58] Field of Search ..... 215/252, 216, 224, 225, 215/258, 317, 318, 333, 272, 250, 274; 220/268, 269

[56] References Cited

U.S. PATENT DOCUMENTS

| | | | |
|---|---|---|---|
| 3,464,576 | 9/1969 | Rohde | 215/252 |
| 3,820,678 | 6/1974 | Zipper et al. | 215/274 X |
| 3,871,544 | 3/1975 | Peyser | 215/225 |
| 4,461,390 | 7/1984 | Csaszar | 215/252 |
| 4,470,513 | 9/1984 | Ostrowsky | 215/252 |
| 4,473,163 | 9/1984 | Geiger | 215/250 |

*Primary Examiner*—Steven M. Pollard
*Attorney, Agent, or Firm*—Charles E. Brown

[57] ABSTRACT

This relates to a plastic fitment to be utilized in conjunction with a conventional metal closure having a rotational engagement with threads on a container neck finish. The fitment has a readily engageable snap-in interlock with the closure and is provided with a tamper indicating band attached to a ring thereof by rupturable bridges. When the closure and fitment are applied to a container, the tamper indicating band will ride over and lock behind a projecting rib on the closure neck finish. When the closure is to be removed, as it moves axially the bridges will rupture leaving the tamper indicating band on the container while the ring of the fitment is removed with the closure. If desired, a customer may remove the ring from the closure and reseal the container with the closure per se.

5 Claims, 5 Drawing Figures

FIG.1
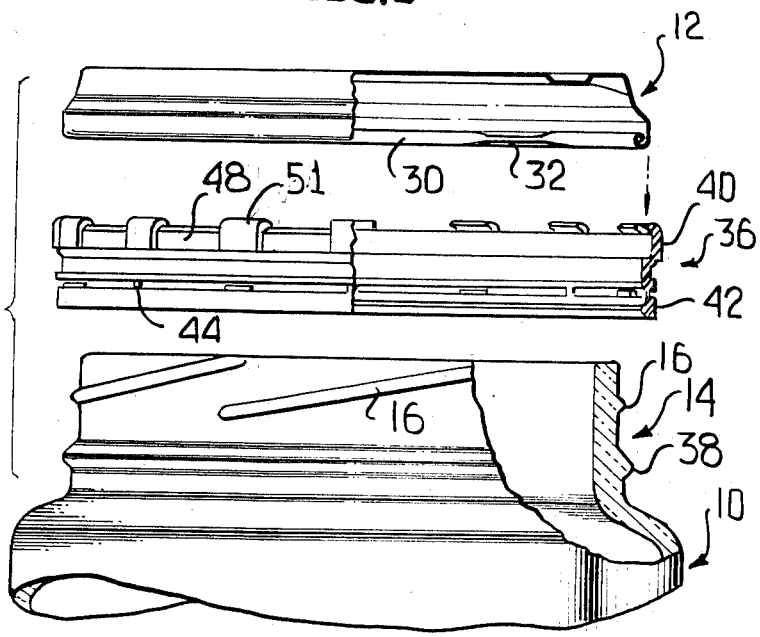
FIG.4
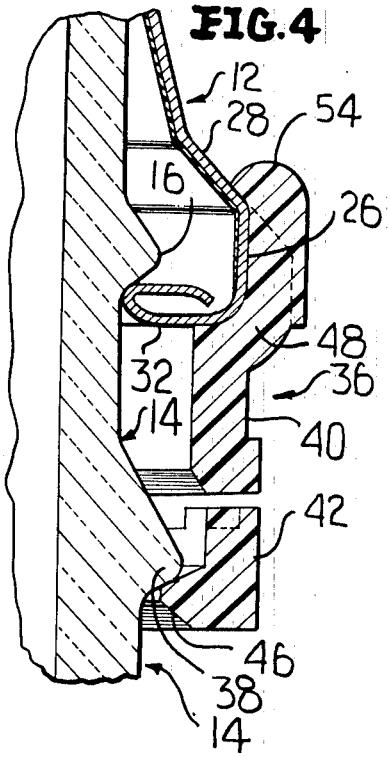
FIG.2
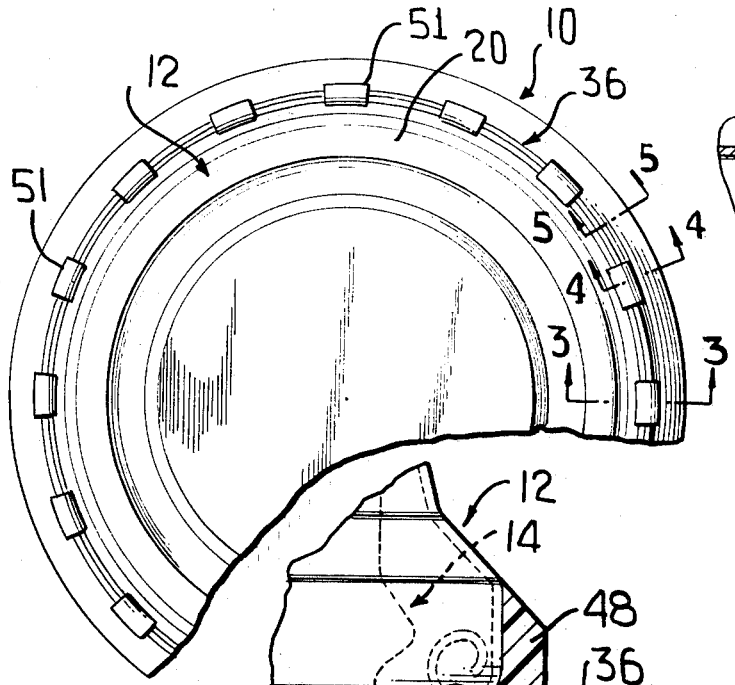
FIG.3
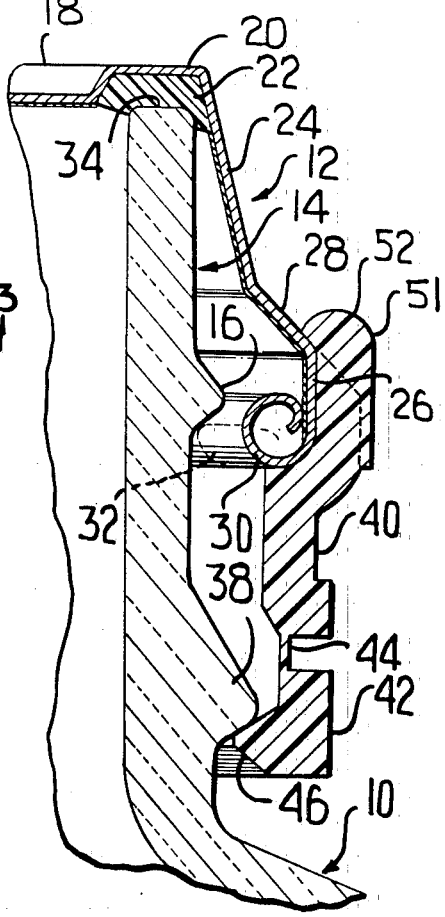
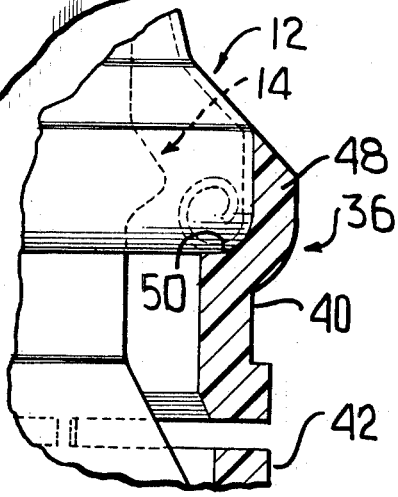
FIG.5

TAMPER INDICATING FITMENT

This invention relates in general to new and useful improvements in closures, and more particularly to a conventional metal closure which is provided with a tamper indicating fitment.

It is known from U.S. Pat. No. 4,228,909, granted Oct. 21, 1980 to Frank H. Lecinski, Jr., to provide a conventional metal closure with a separate plastic tamper indicating band. However, this prior art tamper indicating band was one which prevented the required deformation of the skirt of the closure to effect removal of the closure and does not in any way relate to a closure which is removable by twisting or turning.

In accordance with this invention, there is provided a fitment for use in combination with a metal closure which is rotatable to be released and as it is rotated moves axially whereby, if there is provided an extension having a tamper indicating band locked behind a shoulder, the tamper indicating band will break.

Most particularly, in accordance with this invention there is provided a plastic fitment having an upper portion in the form of a ring and a lower portion in the form of a tamper indicating band, with the band being secured to the ring by rupturable bridges and the ring having at its upper end means for interlocking with a lower portion of the skirt of the conventional metal closure.

Most particularly, the plastic fitment has a ring thereof so constructed as to define a seat surrounded a sleeve wherein a firm engagement between the fitment and the metal closure is obtainable and the sleeve is provided with upwardly extending fingers which are deflectable for interlocking engagement over an upper part of a flared lower skirt portion of the closure.

In accordance with this invention, the force required axially to separate the fitment from the metal closure is greater than that required to separate the tamper indicating band from the fitment ring so that when the closure is removed the bridges securing the tamper indicating band to the ring rupture and the ring of the fitment is removed with the closure. If desired, after the closure has been initially removed, the band of the fitment may be removed from the closure by applying an axial force at a localized area so as progressively to release the fingers from the closure, after which the closure may be utilized in resealing an associated container in a normal manner.

The relationship of the band with respect to the closure, and more particularly the fingers, with respect to the closure is one wherein, when the fitment and the closure are axially aligned, a slight pressure will effect a snap-in engagement of the closure with respect to the fitment so as to provide for automatic assembly and a semi-permanent interlock.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is an exploded elevational view with parts broken away and shown in section of the neck finish of a container, the fitment and a metal closure.

FIG. 2 is a plan view of the closure fitment and container in their assembled state.

FIG. 3 is an enlarged fragmentary sectional view taken generally along the line 3—3 of FIG. 2, and shows the relationship of the three components, the view being taken through one of the fingers of the fitment, but not through one of the thread elements of the closure.

FIG. 4 is a fragmentary vertical sectional view taken along the line 4—4 of FIG. 2, and shows the formation of a lug on the closure and the relationship thereof to the container finish.

FIG. 5 is a fragmentary vertical sectional view taken generally along the line 5—5 of FIG. 2, with the neck finish and closure being shown in elevation, and shows generally the cross section of the ring in an area between adjacent fingers.

Referring now to the drawings in detail, it will be seen that there is illustrated a conventional glass jar generally identified by the numeral 10 which is normally closed by a conventional metal closure generally identified by the numeral 12. The glass jar 10 is provided with a neck finish 14 which includes interrupted threads 16.

The closure 12 includes an end wall 18 which has an outer peripheral downwardly open channel 20 in which there is positioned a gasket or sealant 22. The outer periphery of the end wall 18 is integrally connected to a downwardly extending skirt 24 which has a radially outwardly flared lower portion 26 which is connected to the remainder of the skirt 24 by a downwardly and radially outwardly sloping intermediate portion 28. The skirt portion 26 terminates in a radially inwardly and axially upwardly turned curl 30. At circumferentially spaced intervals the curl 30 is flattened to define lugs 32 which are best shown in FIG. 4. The lugs 32 are engageable with the threads 16 to draw the closure 12 down onto the neck finish 14 and to force the gasket material 22 into engagement with a sealing surface 34 at the extreme end of the neck finish 14.

The thus described closure 12 is cooperable with the neck finish 14 in a normal manner so as to seal the open mouth of the container 10. This invention relates to the provision of a fitment, generally identified by the numeral 36, which will indicate tampering. When the fitment 36 is utilized, the neck finish 14 will be of sufficient axial extent to provide for the placement of a projecting rib 38 disposed in spaced relation below the threads 16, as is clearly shown in FIG. 1.

The fitment 36 is formed of plastic material and includes an upper ring 40 and a lower tamper indicating band 42. The tamper indicating band 42 is connected to the lower edge of the ring 40 by means of circumferentially spaced bridges 44. The bridges 44, as is best shown in FIG. 3, are relatively thin and are readily rupturable when the band 40 is moved axially away from the rib 38. It is to be noted that the tamper indicating band 42 has a radially inwardly directed annular projection 46 which locks beneath the rib 38.

The ring 40 has an upper sleeve 48 which is radially inwardly offset relative to the remainder of the ring 40 so as to define an axially upwardly facing seat 50. The inner surface of the sleeve 48 is such as to tightly engage the outer surface of the lower skirt portion 26.

The sleeve has formed as continuations thereof axially extending and upwardly directed fingers 51 which are circumferentially spaced. Each finger has a radially inwardly projecting part 52 which is positioned for locking engagement over the lower skirt portion 26 as is clearly shown in FIGS. 3 and 4.

It is also to be noted that each finger 51 has a rounded upper surface 54 and that, due to the construction of the closure 12, the closure 12 also has a rounded outer lower surface. Thus, when the fitment 36 is axially aligned with the closure 12, there may be an automatic snap-in engagement of the lower part of the closure 12 into the upper part of the fitment 36 and the resultant interlock of the two, with the lower surface of the closure 12 being seated on the seat 50.

Although in FIG. 1 the fitment 36 has been illustrated as being separate and apart from the closure 12, normally the fitment 36 will be assembled with the closure 12 prior to the application of the closure 12 to the container 10.

Although the closure 12 may be readily interlocked with the fitment 36, and force axially to separate the closure 12 from the fitment 36 is greater than the force required to rupture the bridges 44. Thus, when the closure 12 and the fitment 36 are properly applied to the neck finish 14 and the container 10 is to be opened, when the closure 12 is rotated to disengage the lugs 32 from the threads 16, the closure 12 will move upwardly, but will be restrained by the fitment 36. When sufficient upward force is applied to the fitment 36, the bridges 44 will rupture, leaving the tamper indicating band 42 on the container to indicate that the closure 12 has been at least rotated to the extent of breaking the bridges 44.

If so desired, the closure with the ring 40 still attached may be used to reclose the container 10 in the customary manner. On the other hand, if the customer desires to eliminate the ring 40, it may be readily removed from the closure 12 by disengaging the fingers 51 from the closure at a localized point, at which time the ring will tilt relative to the closure and readily become completely disengaged from the closure, notwithstanding the fact that the axial force required to remove the ring from the closure is greater than that required to rupture the bridges 44.

Although only a preferred embodiment of the fitment has been specifically illustrated and described herein, it is to be understood that minor variations or modifications may be made in the fitment and its relationship to the closure and the container without departing from the spirit and scope of the invention as defined by the appended claims.

I claim:

1. A tamper indicating fitment for use in combination with a metal closure of the type having a flared lower skirt portion, said fitment comprising a plastic ring having a lower tamper indicating band secured thereto by circumferentially spaced bridges, said ring having at its end and internal seat for seating against a metal closure lower skirt portion, and releasable locking means disposed above said seat for locking above a metal closure lower skirt portion, said ring having a sleeve extending around and projecting above said seat, and said locking means are carried by said sleeve, said locking means being in the form of a plurality of circumferentially spaced fingers.

2. A fitment according to claim 1 wherein said fingers are radially outwardly deflectable and have rounded upper free ends for cooperation with a closure lower skirt portion to facilitate snap-in engagement of a closure lower skirt portion into said sleeve and onto said seat.

3. A tamper indicating fitment for use in combination with a metal closure of the type having a flared lower skirt portion, said fitment comprising a plastic ring having a lower tamper indicating band secured thereto by circumferentially spaced bridges, said ring having at its end an internal seat for seating against a metal closure lower skirt portion, and releasable locking means disposed above said seat for locking above a metal closure lower skirt portion, a metal closure of said type having a flared lower skirt portion, said flared lower skirt portion having a lower radially inwardly directed part seated on said seat, and said locking means engaging over said flared lower skirt portion, said ring having a sleeve extending around and projecting above said seat, said sleeve also extending around said closure lower skirt portion, and said locking means being carried by said sleeve, said locking means being in the form of a plurality of circumferentially spaced fingers engaged over said closure flared lower skirt portion.

4. A fitment and closure combination according to claim 3 wherein said fingers are radially outwardly deflectable and have rounded upper free ends cooperable with a lower edge of said closure to facilitate a snap-in engagement of said closure with said fitment.

5. A fitment and closure assembly according to claim 4 wherein said closure has a rounded lower radially outer free end cooperable with said fingers rounded upper free ends to facilitate said snap-in engagement of said closure into said fitment.

* * * * *